US010487990B2

(12) United States Patent
Gielen et al.

(10) Patent No.: US 10,487,990 B2
(45) Date of Patent: Nov. 26, 2019

(54) LIGHTING DEVICE HAVING A WIRELESS COMMUNICATION ANTENNA

(71) Applicant: SIGNIFY HOLDING B.V., Eindhoven (NL)

(72) Inventors: Vincent Stefan David Gielen, Eindhoven (NL); Yacouba Louh, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/768,928

(22) PCT Filed: Oct. 6, 2016

(86) PCT No.: PCT/EP2016/073926

§ 371 (c)(1),
(2) Date: Apr. 17, 2018

(87) PCT Pub. No.: WO2017/067793

PCT Pub. Date: Apr. 27, 2017

(65) Prior Publication Data

US 2019/0056072 A1 Feb. 21, 2019

(30) Foreign Application Priority Data

Oct. 22, 2015 (EP) ..... 15190982

(51) Int. Cl.
*F21V 23/04* (2006.01)
*F21V 23/00* (2015.01)
(Continued)

(52) U.S. Cl.
CPC ..... *F21K 9/238* (2016.08); *F21K 9/232* (2016.08); *F21K 9/237* (2016.08); *F21V 23/002* (2013.01);
(Continued)

(58) Field of Classification Search
CPC .... F21Y 2115/10; F21Y 2107/30; F21K 9/23; F21V 29/70; F21V 23/0435
(Continued)

(56) References Cited

U.S. PATENT DOCUMENTS 2,064,465 A 12/1936 Eustace et al.
2006/0241816 A1 10/2006 Draaijer
(Continued)

FOREIGN PATENT DOCUMENTS

CN 103499037 A 1/2014
CN 103542308 A 1/2014
(Continued)

*Primary Examiner* — William J Carter
(74) *Attorney, Agent, or Firm* — Akarsh P. Belagodu

(57) ABSTRACT

The present invention relates to a lighting device (1, 1*a*) comprising an envelope (3), a carrier (4) arranged inside the envelope (3) and having solid state light sources (5) mounted on the carrier (4), driver circuitry (10) spaced apart from the carrier (4), at least one power line (9) connecting the solid state light sources (5) and the driver circuitry (10), and a wireless communication circuit (13) for receiving control signals, and for controlling the light output, during operation, from the solid state light sources (5). The wireless communication circuit (13) is connected to the at least one power line (9) for using the at least one power line (9) as a wireless communication antenna.

13 Claims, 4 Drawing Sheets

(51) Int. Cl.

| | |
|---|---|
| ***F21V 31/04*** | (2006.01) |
| ***F21V 3/10*** | (2018.01) |
| ***F21K 9/238*** | (2016.01) |
| ***H01Q 1/44*** | (2006.01) |
| ***H01Q 1/46*** | (2006.01) |
| ***H05B 37/02*** | (2006.01) |
| ***F21K 9/232*** | (2016.01) |
| ***F21K 9/237*** | (2016.01) |
| *F21K 9/64* | (2016.01) |
| *F21Y 115/30* | (2016.01) |
| *F21Y 115/10* | (2016.01) |
| *F21Y 115/15* | (2016.01) |
| *F21Y 107/30* | (2016.01) |
| *F21Y 113/13* | (2016.01) |
| *F21V 29/503* | (2015.01) |
| *F21Y 103/00* | (2016.01) |

(52) U.S. Cl.
CPC ..... *F21V 23/003* (2013.01); *F21V 23/0435* (2013.01); *F21V 31/04* (2013.01); *H01Q 1/44* (2013.01); *H01Q 1/46* (2013.01); *H05B 37/0272* (2013.01); *F21K 9/64* (2016.08); *F21V 3/10* (2018.02); *F21V 29/503* (2015.01); *F21Y 2103/00* (2013.01); *F21Y 2107/30* (2016.08); *F21Y 2113/13* (2016.08); *F21Y 2115/10* (2016.08); *F21Y 2115/15* (2016.08); *F21Y 2115/30* (2016.08)

(58) Field of Classification Search
USPC ..... 362/649, 249.02
See application file for complete search history.

(56) References Cited

U.S. PATENT DOCUMENTS

| | | | | |
|---|---|---|---|---|
| 2008/0266834 | A1 | 10/2008 | Wessels | |
| 2013/0136454 | A1* | 5/2013 | Yu ..... | H05B 33/0803 362/235 |

FOREIGN PATENT DOCUMENTS

| | | | |
|---|---|---|---|
| GB | 481950 | A | 3/1936 |
| GB | 2468612 | A | 9/2010 |
| WO | WO2013014821 | A1 | 1/2013 |

* cited by examiner

LIGHTING DEVICE HAVING A WIRELESS COMMUNICATION ANTENNA

CROSS-REFERENCE TO PRIOR APPLICATIONS

This application is the U.S. National Phase application under 35 U.S.C. § 371 of International Application No. PCT/EP2016/073926, filed on OCT. 6, 2016, which claims the benefit of European Patent Application No. 15190982.7, filed on OCT. 22, 2015. These applications are hereby incorporated by reference herein.

FIELD OF THE INVENTION

The present invention relates to a lighting device having a wireless communication antenna.

BACKGROUND OF THE INVENTION

Lighting devices based on solid state lighting (SSL) technology which have an antenna for wireless control of the solid state light sources are known in the art. The intensity and color of the emitted light may for example be controlled in this way. A lighting device of this type is disclosed in WO 2013014821 A1. That lighting device has an antenna that may be arranged inside or around a support member for a semiconductor light emitting element.

It is desirable to find ways to incorporate antennas into the designs of existing lighting devices without significant modifications so that the addition of unnecessary costs and complexity to the production process is avoided.

GB 2468612 discloses a vehicle mounted patch antenna apparatus. The apparatus has a ground conductor which is arranged on a substrate. An antenna element is positioned US 2006/241816 discloses a lamp for a street lighting system, said lamp having a network element is arranged inside the fitting which is used for connecting lamp electrically or mechanically to a lamp socket. The network element communicates wirelessly with network element of another lamp.

US 2008/266834 discloses a device for wireless control of e.g. high intensity discharge type fluorescent lamp, has control interface coupled to electrode that is used as antenna for wireless control of lamp.

GB 481950 discloses an arrangement for feeding electric current from an alternating current supply source to a load device such as a lamp. The lamp comprises a radio receiver or transmitter and the supply source are coupled to said conductors over separate transformers situated at the base of the mast.

U.S. Pat. No. 2,064,465 discloses an antenna system having two vertical radiating aerials spaced apart and a screened horizontal feeder connected to high frequency apparatus extending between said two aerials and coupled thereto, of an electrical power supply circuit coupled to both said aerials.

US 20/13/136454 discloses a LED light source used for lighting apparatus installed on wall, has optical element that is connected to base, and is provided to cover light source plate, supporting frame and antenna unit of transceiver module

SUMMARY OF THE INVENTION

It is an object of the present invention to improve the current state of the art, to solve at least some of the above problems, and to provide an improved or alternative lighting device having a wireless communication antenna. These and other objects are achieved by a lighting device according to the appended claims.

According to a first aspect of the present invention, there is provided a lighting device comprising an envelope, a carrier arranged inside the envelope and having solid state light sources mounted on the carrier, driver circuitry spaced apart from the carrier, at least one power line connecting the solid state light sources and the driver circuitry, and a wireless communication circuit for receiving control signals for controlling the light output, during operation, from the solid state light sources. The wireless communication circuit is connected to the at least one power line for using the at least one power line as a wireless communication antenna.

The present invention is based on the realization that at least one power line of a lighting device may be utilized as a wireless communication antenna, and that wireless signals may be received, or transmitted, by superimposing the wireless signal on top a direct current carried by power lines in a lighting device. Thereby, the at least one power line provides an additional function and the cost of a lighting device having wireless communication may be reduced. The antenna does not take up any space on a substrate, e.g. the carrier and the use of substrate material may be reduced. The introduction of wireless communication typically requires considerably more space for electronic components, especially the antenna. The present invention provides a solution using components already present, which means that no additional space is required. The reduced need for a substrate, or substrate space, achieved by forming the antenna with at least one power line, may therefore reduce the problem of degassing volatile organic compounds, VOCs, and moisture release within the envelope. A reduced amount of degassing of VOCs inside the envelope means that less oxygen is needed to prevent a degradation of the solid state light sources. A reduced amount of moisture release within the envelope means less risk of degradation of the solid state light sources. Further, the antenna formed by the at least one power line is not shielded, e.g. surrounded, by metal parts and may have good reception. The reception property of the antenna may be tuned by configuring the antenna length.

In at least one exemplary embodiment, the at least one power line has an antenna portion arranged between the solid state light sources and the driver circuitry, and the antenna portion is connected in series between the wireless communication circuit and the solid state light sources. Alternatively, the antenna portion may be connected in series between the wireless communication circuit and the driver circuitry. Hence, the position of the antenna portion and/or the wireless communication circuit may be adapted to e.g. the design or limited space of different types of lighting devices.

In at least one exemplary embodiment, the lighting device comprises two power lines, and the wireless communication circuit is connected to both of the two power lines. Thereby, the two power lines may be used as a dipole wireless communication antenna.

In at least one exemplary embodiment, the at least one power line may be formed by connecting a carrier wire attached to the carrier to a stem wire attached to the envelope. Hence, the power line may be formed during assembly by contacting the carrier wire and the stem wire to each other. The carrier wire may also be known as an L2-wire. The stem wire may also be known as an envelope wire, or an exhaust wire. The carrier wire and stem wire may be attached to each other by for example welding.

In at least one exemplary embodiment, the lighting device further comprises a first radio frequency choke connected in series between the antenna portion and the driver circuitry, and a second radio frequency choke connected in series between the antenna portion and the solid state light sources. The first and second radio frequency chokes may efficiently delimit which portion of the at least one power line is utilized as an antenna portion. Further, the radio frequency chokes prevents, or at least minimizes, alternating electrical power reaching the solid state light sources and the driver circuitry.

In at least one exemplary embodiment, the lighting device further comprises a direct current choke connected in series between the at least one power line and the wireless communication circuit. The direct current choke prevents, or at least minimizes, the amount of direct current electrical power which reaches the more delicate circuitry of the wireless communication circuitry from the at least one power line. It should be noted that the wireless communication circuitry may still be driven by the driver circuitry, e.g., by an additional feeder wire and not the connection to the at least one power line.

In at least one exemplary embodiment, a length of the at least one power line is configured to correspond to a specific frequency at which the lighting device is to receive control signals. Thereby, the at least one power line may more efficiently receive control signals. The power line may be provided in pre-determined length, at assembly, or the length of the power lines may be configured through cutting the at least one power line.

In at least one exemplary embodiment, the lighting device further comprises an exhaust tube arranged inside the envelope, the carrier may be a tubular light source carrier attached to the exhaust tube, the exhaust tube being arranged partly inside the tubular light source carrier. By "exhaust tube" is meant a tube through which a gas may be introduced into the lighting device during production and which is later sealed. Exhaust tubes are often found in general lighting service (GLS) bulbs, i.e. conventional incandescent light bulbs. During the production of such light bulbs, the exhaust tube allows for air to be exhausted from the bulb and an inert gas to be pumped into the bulb. Modern lighting devices based on SSL technology may also have an exhaust tube for introducing a gas into the envelope that encloses the solid state light sources. The gas may improve the heat transfer from the solid state light sources as well as the lifetime of the lighting device by reducing lumen depreciation of the solid state light sources. The exhaust tube is electrically isolating and may for example be made of glass. A tubular light source carrier promotes efficient heat transfer from the light sources by creating convection currents through the carrier. In other words, the tubular light source carrier may give rise to a thermal chimney effect where a fluid circulates through the tubular light source carrier.

In at least one exemplary embodiment, the wireless communication circuit is arranged on the carrier. In other words, the wireless communication circuit may be positioned completely inside the envelope, supported by the light source carrier. Thereby, the wireless communication circuit does not need a separate carrier. Further, this may facilitate electrically connecting the wireless communication circuit to the solid state light sources for example via the carrier. Alternatively, the wireless communication circuit may be arranged outside the envelope. This means that fewer electronic components need to be placed within the atmosphere within the envelope which may reduce the amount degassing of VOCs and the amount of moisture in the envelope.

In at least one exemplary embodiment, the at least one power line and the wireless communication circuit are configured to receive wireless signals at radio frequencies. Radio frequencies are the electromagnetic frequencies between 3 kHz and 300 GHz. The present invention typically relates to the radio frequencies between 1 MHZ and 10 GHz.

In at least one exemplary embodiment, the lighting device comprises a connector for mechanically and electrically connecting the lighting device to a lamp socket. In at least one exemplary embodiment, the lighting device is a gas filled light bulb.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
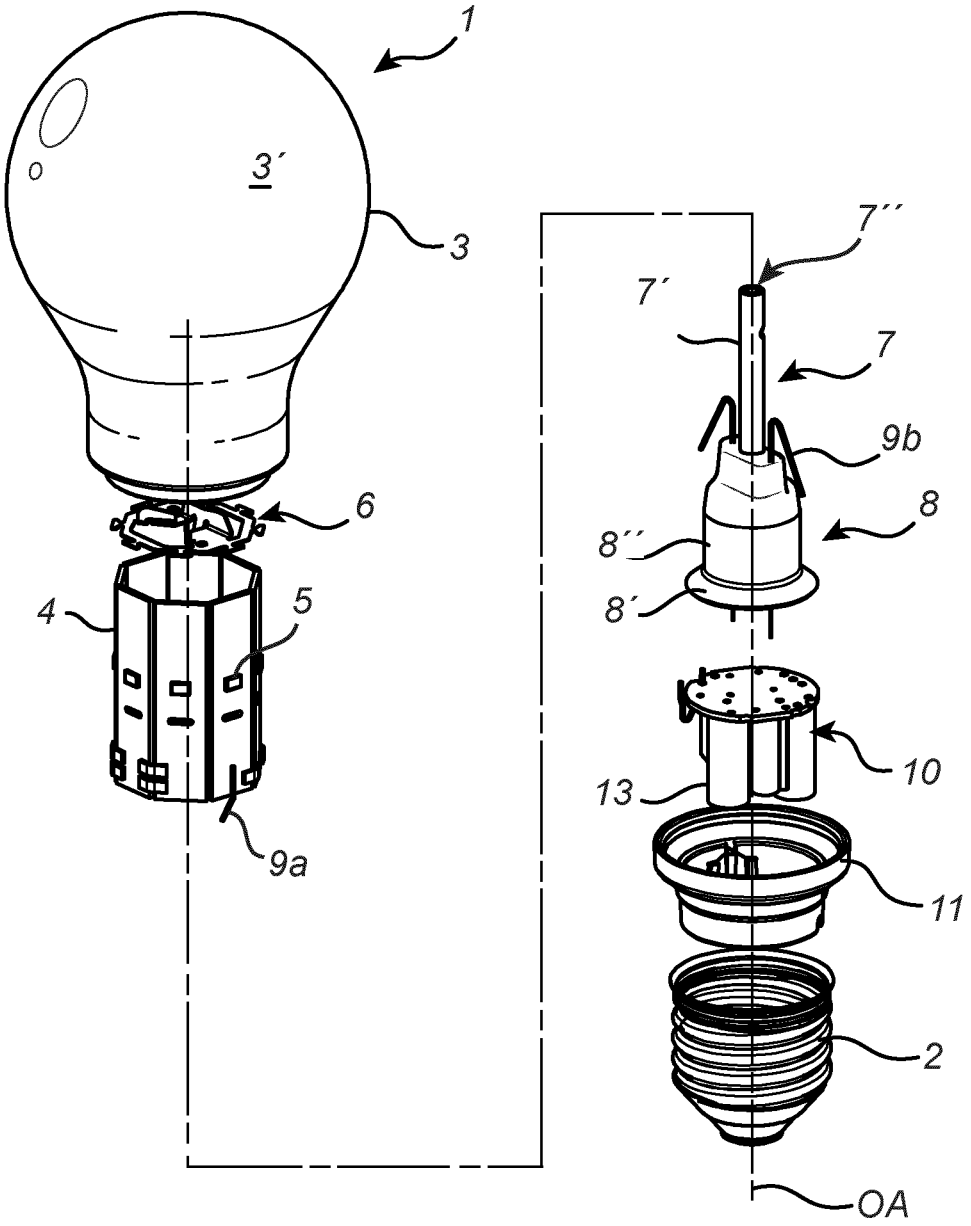
FIG. 1 is an exploded perspective view of a lighting device in accordance with at least one embodiment of the invention.

In the present detailed description, exemplary embodiments of a lighting device according to the present invention are mainly discussed with reference to schematic views showing a lighting device according to various embodiments of the invention. It should be noted that this by no means limits the scope of the invention, which is also applicable in other circumstances for instance with other types or variants of lighting device or components than the embodiments shown in the appended drawings. Further, that specific components are mentioned in connection to an embodiment of the invention does not mean that those components cannot be used to an advantage together with other embodiments of the invention. The invention will now be described with reference to the enclosed drawings where first attention will be drawn to the structure, and secondly to the function. Like reference characters refer to like elements throughout the description.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 2:
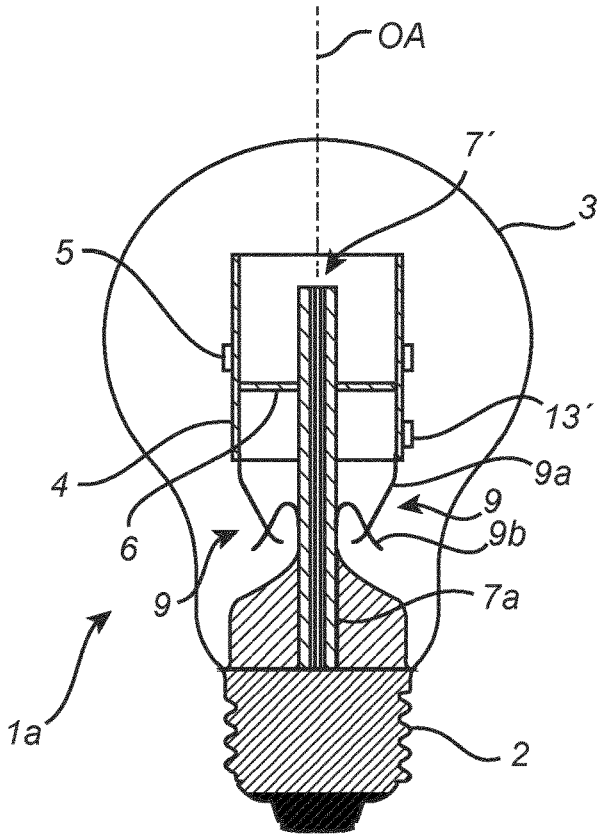
FIG. 2 is a cross-sectional schematic view of a lighting device in accordance with at least one embodiment of the invention.
Figure 3:
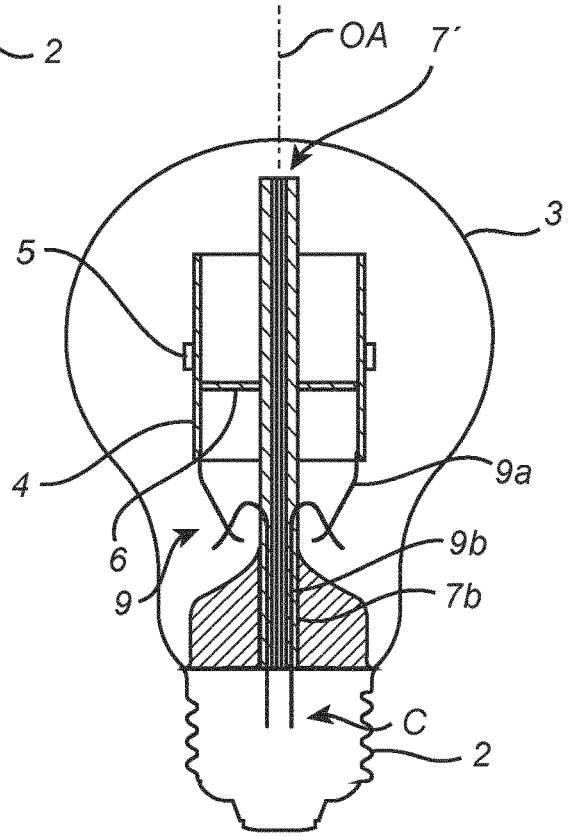
FIG. 3 is a cross-sectional schematic view of a lighting device in accordance with at least one embodiment of the invention.

FIGS. 1-3 are schematic views of lighting devices 1, 1*a* in order to explain the structural elements and component of lighting devices in according with the different embodiments of the invention.

FIGS. 4*a-d* are schematic views of electric circuit diagrams for a lighting device in accordance with different embodiments of the invention. Generally in FIGS. 4*a-d* only three serially connected light sources 5 are shown for the sake of brevity. It is of course possible that there is just one or two, or more than three light sources 5 mounted on the carrier 4. Likewise the light source 5 may also or instead be connected in parallel and/or series in any suitable manner. The wireless communication circuit 13 is arranged to control the light output from the light source 5, although no explicit connection is shown in FIGS. 4*a-d* for such a functionally as there are many possible solutions. For example, the wireless communication circuit 13 may control the driver circuitry 10, or be connected to the light sources 5 for direct control.

FIG. 1 shows an example of a lighting device 1 in the form of a light bulb, such as a retrofit A60 light bulb. The lighting device 1 has an optical axis OA which is a central axis of the lighting device 1. The lighting generated by the lighting device 1 is in this example substantially rotationally symmetric around the optical axis OA. A connector 2 is arranged at an end of the lighting device 1. The connector 2 is adapted to mechanically and electrically connect the lighting device 1 to a lamp socket. In the illustrated example, the connector 2 is a screw base, for example an E27 screw base, but the connector 2 may be of a different type, for example a bayonet light bulb mounting. The connector 2 is typically made of a metal.

The lighting device 1 has a light transmissive envelope 3, the center of which is displaced along the optical axis OA relative to the connector 2. The envelope 3 can be made of glass or plastics, for instance. In the illustrated example, the envelope 3 has a pear-like shape formed by a round head portion and a circular cylindrical neck portion, the head portion and neck portion being distal and proximate to the connector 2, respectively. The envelope 3 is filled with a gas, for example helium or a mix of helium and oxygen. The lighting device 1 is thus a gas filled light bulb. Optionally, there may be a surface layer 3' on the inside of the envelope 3. The surface layer 3' may be a light scattering layer or a wavelength converting layer. Examples of light scattering layers include coatings of $TiO_2$, $BaSO_4$, or $Al_2O_3$ scattering particles in a silicone polymer matrix. A wavelength converting layer may be used for altering the color of the light emitted by the solid state light sources. For example, a common technique to provide white light is to combine a non-white light source with a wavelength converter. The wavelength converter converts some of the light emitted by the light source to a wavelength such that the mix of converted and unconverted light appears white or almost white to the eye. Examples of wavelength converting layers include coatings comprising one or more phosphors, such as YAG, LuAG and ECAS.

A tubular light source carrier 4 (henceforth referred to as the "carrier" for brevity) is centered on the optical axis OA inside the envelope 3. The carrier 4 in this example has an octagonal cross section perpendicular to the optical axis OA but other cross sections, shapes, such as hexagonal or circular cross sections, are possible. It should be noted that other embodiments of the lighting device 1 may have carriers that are not tubular. Several solid state light sources 5 (henceforth referred to as the "light sources" for brevity) are mounted on the carrier 4. The main direction of light from the light source 5 is radially outwards, towards the envelope 3. The light sources 5 and the carrier 4 together form an L2 structure. The carrier 4 comprises a circuit board for electrically connecting the light sources 5, for example a printed circuit board. The carrier 4 comprises two carrier wires 9*a*. The carrier wires 9*a* are used to connect the carrier 4, and thus light sources 5, to an electrical source which, in use, drives the light sources 5. The carrier 4 may also be adapted to be a heat sink for the light sources 5, allowing heat to be transferred efficiently from the light sources 5 to the surrounding gas inside the envelope 3. The light sources 5 may for example be semiconductor light emitting diodes, organic light emitting diodes, polymer light emitting diodes, or laser diodes. All of the light sources 5 may be configured to emit light of the same color, for example white light, or different light sources 5 may be configured to emit light of different colors.

A fastener 6, sometimes referred to as a "spider", inside the carrier 4 attaches the carrier 4 to an exhaust tube 7 of the lighting device 1. The fastener 6 may for example have protrusions that mate with holes in the carrier 4 and a locking feature that clamps to the exhaust tube 7. By this arrangement, the carrier 4 surrounds a portion of the exhaust tube 7 so that the exhaust tube 7 is partly arranged in the interior space of carrier 4. The exhaust tube 7 extends along the optical axis OA which coincides with the central axis of the carrier 4. The exhaust tube 7 is integrated with a stem element 8 having a larger diameter than the exhaust tube 7. The stem element 8 and the exhaust tube 7 are typically made of glass. A portion of the exhaust tube 7 is inside the stem element 8 and another portion of the exhaust tube 7 is outside the stem element 8, the outside portion 7' having an open end 7" and supporting the carrier 4 via the fastener 6. The stem element 8 has a proximal portion 8', which is proximal to the connector 2, and a distal portion 8" which is distal to the connector 2. The proximal portion 8' is sealed to the connector 2. The outside portion 7' of the exhaust tube 7 extends from the distal portion 8" along the optical axis OA.

Two stem wires 9*b* are fixed to the stem element 8. The contact wires 9*b* may also be known as contact wires or envelope wires. It may be noted that the assembly consisting of the stem element 8, the exhaust tube 7 and the stem wires 9*b* is sometimes referred to as the "stem" of a light bulb. The stem wires 9*b* protrude from the stem element 8 and electrically connect the carrier 4, via the carrier wires 9*a*, to driver circuitry 10 for powering the light sources 5 when the lighting device 1 is fully assembled. Hence, the stem wires 9*b* are shaped such that when the stem 8 is inserted into the envelope, the stem wires 9*b* contact the carrier wires 9*a*. The stem wires 9*b* may thus have a curved or bent shape as illustrated in FIG. 1. The stem wires 9*b* and the carrier wires 9*a* may further be fixated to each other e.g. by welding. The mechanically and electrically connected stem wires 9*b* and carrier wires 9*a* thereby forms power lines 9 which electrically connect the driver circuitry 10 to the carrier 4 and light sources 5. The solid state light source 5 are typically driven by DC current, and during operation the driver circuitry 10 therefore supplies a DC current via one of the power lines 9 and the other one of the power lines 9 is used a 'return'-wire. The driver circuitry 10 therefore typically converts the AC current found in mains electricity to DC current suitable for the light sources 5. The driver circuitry 10 is in this example arranged inside the connector 2 but may in other examples be arranged completely inside the envelope 3, supported by for example the carrier 4 or the fastener 6. An isolation part 11, which electrically isolates some parts of the driver 10 from the connector 2, may be arranged between the driver 10 and the connector 2.

A wireless communication circuit 13 is arranged inside the connector 2. The wireless communication circuit 13 is electrically connected to at least one of the stem wires 9*b*, and thus at least one of the carrier wires 9*a* when fully assembled. The wireless communication circuit 13 is configured to utilize at least one of the power lines 9 as a monopole antenna, to receive control signals and then control the light sources 5. The power lines 9 may henceforth also be called antennas 9. Hence, the wireless communication circuit 13 usually comprises a microcontroller and a radio frequency receiver. The wireless communication circuit 13 is in this example integrated with the driver circuitry 10, but may be a separate unit in other examples. The control circuit 13 may be powered by the driver 10. The length of the antenna 9 is usually approximately equal to a quarter of the wavelength or half the wavelength of the control signals which are received with the antenna 9. A typical antenna length is about 3 cm or 6 cm.

In an alternative embodiment the wireless communication circuit 13 is connected to both stem wires 9*b* and thus both carrier wires 9*a*. The wireless communication circuit 13 then utilizes both the power lines 9 as antennas, e.g. as a dipole antenna. In use, the lighting device 1 is put in operation by plugging the connector 2 into an electrical socket connected to an electricity supply, whereby the driver 10 supplies power to the light sources 5 via the power lines 9 and the carrier 4. The light sources 5 emit light that is transmitted through the envelope 3. A mobile device such as a smartphone may be used to control the light sources 5 by sending radio frequency signals to the antenna 9 formed by the stem wires 9*b* and the carrier wires 9*a*. The signals received by the antenna 9 are processed by the wireless communication circuit 13 which controls the light sources 5. Depending on the application, it may be possible to for example turn the light sources on and off, to dim the light sources and to change the color settings of the lighting device. It is of course also conceivable that the wireless communication circuit 13 controls the light sources 5 indirectly through controlling the driver circuitry 10.

Figure 4A:
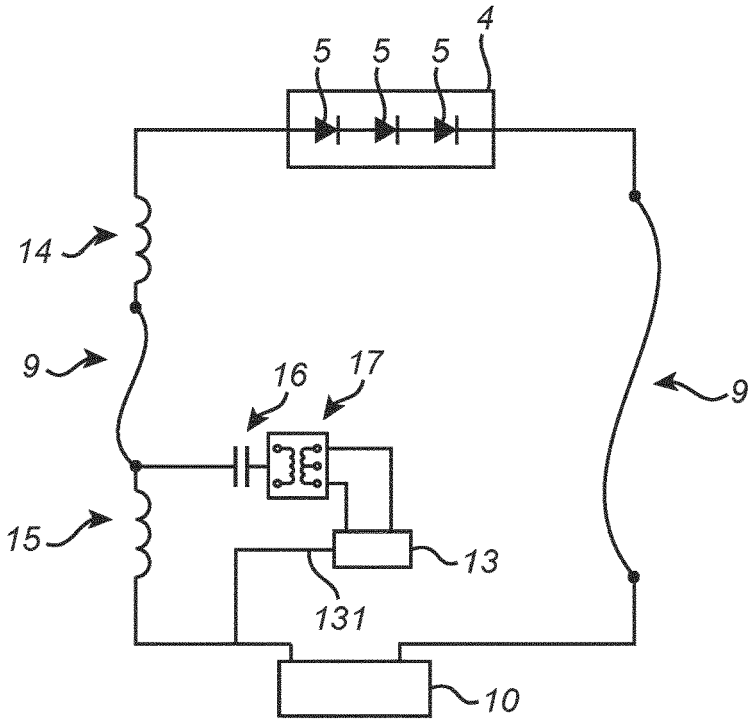
FIGS. 4*a-d* are schematic views of electric circuit diagrams for a lighting device in accordance with different embodiments of the invention.

FIG. 4*a* shows a schematic electric circuit diagram for the lighting device 1 shown in FIG. 1 where one of the power lines 9 is used as a monopole wireless communication antenna. The driver circuitry 10 is connected to the carrier 4 and thus light sources 5 via a radio frequency choke 15 connected in series prior to the power line 9 and a radio frequency choke 14 after the power line 9 towards the light source 5. Thereby, radio frequency signals, e.g. AC signals, on the power line 9 are prevented from interfering or harming either the driver circuitry 10 or the light sources 5. The wireless communication circuit 13 is connected in series between the driver circuitry 10 and the power line 9. The wireless communication circuit 13 is connected to the driver circuitry 10 via a feeder wire 131 for providing power to the wireless communication circuitry 13. The wireless communication circuitry 13 is connected to the power line 9 in series via a transformer 17 and a direct current choke 16. The transformer 17 may increase the voltage of the signals received from the power lines 9 and electrically couple them to the wireless communication circuit 13. It should be noted that the transformer 17 is optional. The direct current choke 16 prevent the direct current being fed from the driver circuitry to the light sources 5 from interfering or harming the delicate circuits of the wireless communication circuit 13. In this regard it should be noted that the transformer 17 also galvanically isolates the wireless communication circuit 13 from the power lines 9.

The radio frequency choke(s) 14, 15 may be any type of suitable inductor. The direct current choke 16 may be any type of suitable capacitor.

FIG. 2 shows an example of a lighting device 1*a* which is similar to the one in FIG. 1 except that the wireless communication circuit 13 is instead arranged on the carrier 4 within the envelope 3.

Figure 4B:
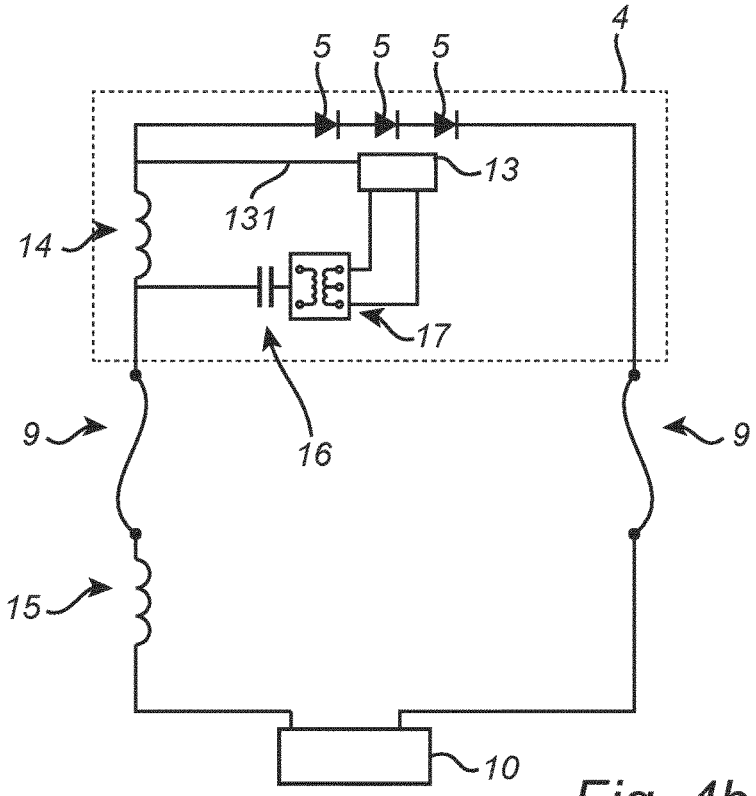

FIG. 4*b* shows a schematic electric circuit diagram for the lighting device 1*a* shown in FIG. 2 where one of the power lines 9 is used as a monopole wireless communication antenna. The difference to the electric circuit diagram shown in FIG. 4*a* being that the wireless communication circuit 13, radio frequency choke 14, direct current choke 16, and transformer 17 are arranged on the carrier within the envelope 3. The wireless communication circuit 13 is connected in series between the power lines 9 and the light sources 5.

Figure 4C:
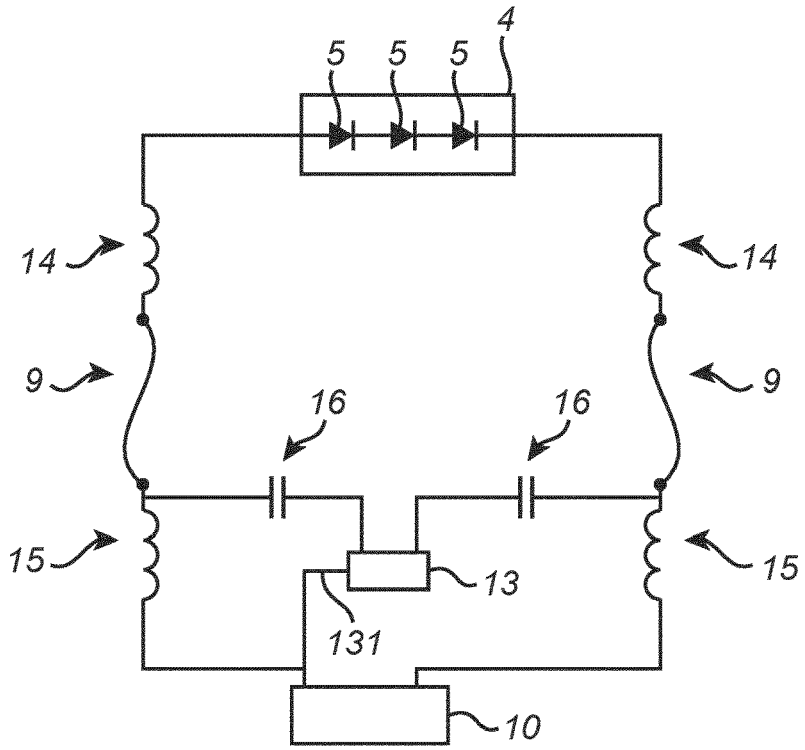
Figure 4D:
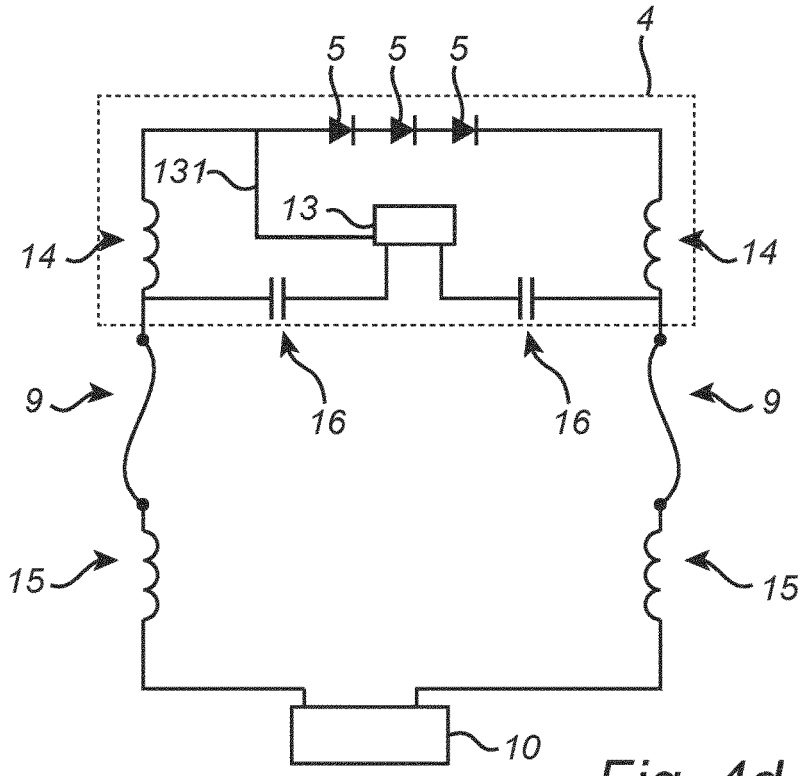

FIGS. 4*c* and 4*d* shown an alternative schematic electric circuit diagram for the lighting device 1 shown in FIG. 1 where both the power lines 9 are used, for example as a dipole wireless communication antenna. The wireless communication circuitry 13 is connected to each of the power lines 9 via a direct current chokes 16 and the portion of the power lines 9 which are used as a wireless antenna is delimited in the same manner as described for FIG. 4*a* with radio frequency chokes 14, 15. In FIG. 4*c* the wireless communication circuit 13 is arranged in the connector of the lighting device, whereas in FIG. 4*d* the wireless communication circuit 13 is arranged on the carrier 4.

It should be noted that it is of course also possible to optionally add a transformer, e.g. between each power line 9 and the wireless communication circuit 13, in the same manner as shown in FIGS. 4*a* and 4*b*.

For the embodiments shown in FIGS. 4*c* and 4*d* each of the power lines 9 may optionally be used differently, e.g. as wireless communication antennas configured for different frequencies.

FIG. 3 shows a cross-section of lighting device which is similar to the ones in FIGS. 1 and 2. The length of the antenna 9 may be configured by cutting the stem wires 9*b*, such that an appropriate antenna length is provided, by cutting at the lower end indicated by the arrow C. For example, a typical antenna length is about 3 cm or 6 cm. By way of mention, it should be noted that the two antennas 9 formed may have a different lengths such that they are configured or tuned for different radio frequencies. The wireless communication circuit 13 may thus be connected to the two antennas 9 and utilize the antennas 9 for different frequencies.

An exemplary method for producing a lighting device, such as a gas filled light bulb is hereinafter described. The method includes a step in which the exhaust tube 7, is put in a holder suitable for a glass melting and fusion process together with a glass stem element 8 and stem wires 9*b*. The distal portion 8" of the stem element 8 is heated up to a temperature where the glass becomes viscous, and the exhaust tube 7 is indirectly heated to the same temperature. The hot glass is pressed so that an airtight connection is formed between the stem element 8 and the exhaust tube 7 and also between the stem element 8 and the stem wires 9*b*. The pressing of the glass creates what is usually referred to as a "pinch" on the stem element 8. The glass is then allowed to cool down somewhat, after which a small area of the pinch between the stem wires 9*b* is heated up again and a small hole is made through the pinch by introducing pressurized air into the exhaust tube 7. The hole makes it possible to connect the exhaust tube 7 to the inside of the light bulb once the stem 8 is sealed to the envelope 3. The light source carrier 4 with the solid state light sources 5 is then mounted on the exhaust tube 7 and electrically connected to the stem wires 9*b* via the carrier wires 9*a*, for example by welding. The whole assembly is positioned inside a glass envelope 3 which is sealed to the proximal portion 8' of the stem element 8 by heating the glass from the outside while the stem and envelope assembly is rotated. Next the light bulb is flushed, filled and closed in a process that is sometimes referred to as "pumping and tipping". The inside of the envelope 3 is cleaned by repeated flushing with an inert gas, wherein a special type of valve is used to control the gas flow through the exhaust tube 7. A filling gas is pumped into the cleaned envelope 3 through the exhaust tube 3 by means of a filling system. The length of the stem wires 9*b* may now be configured by cutting the stem wires 9*b* to an appropriate length. Next, an airtight connection is formed in the exhaust tube 7 so that the filling gas cannot escape from the envelope 3 through the exhaust tube 7. This may be done by heating the exhaust tube 7, between the envelope 3 and the valve, and pressing the heated exhaust tube 7 with a tool. A portion of the exhaust tube 7 that is outside the envelope 3 is then removed, for instance by "scoring and breaking" the exhaust tube 7. This involves creating a weak spot that makes it possible to break the exhaust tube 7 at a precise point. The weak spot can for example be created by scratching the exhaust tube 7 with a diamond knife or by locally reducing the diameter of the exhaust tube 7 through heating and pressing. Finally, a connector 2 is attached to the envelope 3, and the electronics inside the connector 2 is connected to the stem wires 9*b*, for example by electric welding or soldering or by means of piercing connectors or poke-in connectors.

The person skilled in the art realizes that the present invention by no means is limited to the preferred embodiments described above. On the contrary, many modifications and variations are possible within the scope of the appended claims. For example, the shape of the envelope 3 is not limited to a pear-like shape. Some examples of other envelope shapes include cylindrical, ellipsoidal and conical.

Further, the wireless communication circuit 13 may of course be used also to transmit information about e.g. the status of the lighting device 1.

The skilled person realizes that a number of modifications of the embodiments described herein are possible without departing from the scope of the invention, which is defined in the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lighting device comprising:

an envelope;

a carrier connected to a stem element, arranged inside said envelope and having solid state light sources mounted on said carrier;

driver circuitry spaced apart from said carrier;

at least one power line connecting said solid state light sources and said driver circuitry;

a wireless communication circuit configured to receive control signals, and control the light output, during operation, from said solid state light sources; and wherein said wireless communication circuit is connected to said at least one power line for using said at least one power line as a wireless communication antenna, wherein said at least one power line is formed by a carrier wire attached to said carrier and a stem wire attached to said envelope and connected to the carrier wire, and wherein said at least one power line has an antenna portion that has a transceiving portion which is arranged between the solid-state light sources and the driver circuitry.

2. The lighting device according to claim 1, wherein said antenna portion is connected in series between said wireless communication circuit and said solid state light sources.

3. The lighting device according to claim 2, wherein said lighting device further comprises a first radio frequency choke connected in series between said antenna portion and said driver circuitry, and a second radio frequency choke connected in series between said antenna portion and said solid state light sources.

4. The lighting device according to claim 2, wherein said wireless communication circuit is arranged on said carrier.

5. The lighting device according to claim 1, wherein said antenna portion is connected in series between said wireless communication circuit and said driver circuitry.

6. The lighting device according to claim 5, wherein said wireless communication circuit is arranged outside said envelope.

7. The lighting device according to claim 1, wherein the lighting device comprises two power lines, and said wireless communication circuit is connected to both of said two power lines.

8. The lighting device according to claim 1, further comprising a direct current choke connected in series between said at least one power line and said wireless communication circuit.

9. The lighting device according to claim 1, wherein a length of said at least one power line is configured to correspond to a frequency at which the lighting device is to receive control signals.

10. The lighting device according to claim 1, further comprising an exhaust tube arranged inside the envelope, wherein said carrier is a tubular light source carrier attached to the exhaust tube, the exhaust tube being arranged partly inside the tubular light source carrier.

11. The lighting device according to claim 1, wherein said at least one power line and said wireless communication circuit are configured to receive wireless signals at radio frequencies.

12. The lighting device according to claim 1, further comprising a connector for mechanically and electrically connecting the lighting device to a lamp socket.

13. The lighting device according to claim 1, wherein the lighting device is a gas filled light bulb.

* * * * *